US007951057B2

(12) United States Patent
Robertson et al.

(10) Patent No.: US 7,951,057 B2
(45) Date of Patent: May 31, 2011

(54) MULTI-LAYER HEAT INSULATING CONTAINER

(75) Inventors: Ronald D. Robertson, Kansas City, MO (US); William D. McKahan, Kansas City, MO (US)

(73) Assignee: Huhtamaki, Inc., Desoto, KS (US)

( * ) Notice: Subject to any disclaimer, the term of this patent is extended or adjusted under 35 U.S.C. 154(b) by 0 days.

(21) Appl. No.: 12/577,295

(22) Filed: Oct. 12, 2009

(65) Prior Publication Data

US 2010/0029453 A1 Feb. 4, 2010

Related U.S. Application Data

(62) Division of application No. 11/460,265, filed on Jul. 27, 2006, now Pat. No. 7,828,199.

(51) Int. Cl.
*B31B 17/28* (2006.01)

(52) U.S. Cl. ..... 493/95; 493/84; 493/93; 493/152; 493/154; 493/175; 493/386; 493/388; 229/403; 229/4.5; 220/739

(58) Field of Classification Search ..... 493/51–52, 493/84, 89, 93–95, 111–115, 121, 129, 133, 493/152, 154, 175, 379, 386, 388, 393, 907; 229/400, 403, 4.5; 220/739
See application file for complete search history.

(56) References Cited

U.S. PATENT DOCUMENTS 3,049,277 A 8/1962 Shappell
5,092,485 A 3/1992 Lee
5,205,473 A 4/1993 Coffin, Sr.
5,363,982 A 11/1994 Sadlier
5,542,599 A 8/1996 Sobol
5,547,124 A 8/1996 Mueller
5,759,624 A 6/1998 Neale et al.
5,775,577 A 7/1998 Titus
5,839,653 A 11/1998 Zadravetz
5,950,971 A 9/1999 Koumbis et al.
6,068,182 A 5/2000 Tokunaga
6,085,970 A 7/2000 Sadlier
6,126,584 A 10/2000 Zadravetz
6,142,331 A 11/2000 Breining et al.
6,186,394 B1 2/2001 Dees et al.
6,224,954 B1 5/2001 Mitchell et al.
6,253,995 B1 7/2001 Blok et al.
6,257,485 B1 7/2001 Sadlier et al.
6,267,837 B1 7/2001 Mitchell et al.
6,287,247 B1 9/2001 Dees et al.
6,422,456 B1 7/2002 Sadlier (Continued)

FOREIGN PATENT DOCUMENTS

WO 2005102847 A1 11/2005

(Continued)

*Primary Examiner* — Christopher Harmon
(74) *Attorney, Agent, or Firm* — Husch Blackwell LLP

(57) ABSTRACT

A storage container includes a receptacle having a circumferential sidewall and a sleeve fixedly attached to the receptacle having a circumferential sidewall with a left edge, a right edge, and marginal portions adjacent the left and right edges wherein the edges meet to form a butt seam. The receptacle sidewall and the sleeve sidewall define an insulating layer therebetween. The insulating layer includes a first edge and a second edge wherein the first and second edges do not extend under the marginal portions such that the insulating layer has a smaller circumference than that of the sleeve sidewall. A method for forming a storage container is also provided.

9 Claims, 3 Drawing Sheets

U.S. PATENT DOCUMENTS

| | | | | |
|---|---|---|---|---|
| 6,536,657 | B2 * | 3/2003 | Van Handel | 229/403 |
| 6,586,075 | B1 | 7/2003 | Mitchell et al. | |
| 6,598,786 | B1 | 7/2003 | Guo | |
| 6,663,926 | B1 | 12/2003 | Okushita et al. | |
| 6,729,534 | B2 * | 5/2004 | Van Handel | 229/403 |
| 6,811,843 | B2 | 11/2004 | DeBraal et al. | |
| 6,926,197 | B2 | 8/2005 | Hed et al. | |
| 7,458,504 | B2 * | 12/2008 | Robertson et al. | 229/403 |
| 7,464,856 | B2 * | 12/2008 | Van Handel | 229/403 |
| 7,510,098 | B2 * | 3/2009 | Hartjes et al. | 220/592.2 |
| 7,549,273 | B2 * | 6/2009 | Dart et al. | 53/463 |
| 7,600,669 | B2 * | 10/2009 | Van Handel | 229/403 |
| 7,828,199 | B2 * | 11/2010 | Robertson et al. | 229/198.2 |
| 2005/0227029 | A1 | 10/2005 | Dart et al. | |
| 2005/0236468 | A1 * | 10/2005 | Sadlier | 229/403 |
| 2006/0144915 | A1 | 7/2006 | Sadlier | |
| 2006/0196923 | A1 * | 9/2006 | Tedford, Jr. | 229/403 |
| 2008/0156857 | A1 * | 7/2008 | Johnston | 229/100 |
| 2008/0280742 | A1 * | 11/2008 | Cerasani | 493/55 |

FOREIGN PATENT DOCUMENTS

| | | | |
|---|---|---|---|
| WO | 2006065849 | A1 | 6/2006 |

* cited by examiner

MULTI-LAYER HEAT INSULATING CONTAINER

CROSS-REFERENCE TO RELATED APPLICATIONS

This Application is a Divisional of and claims priority to U.S. application Ser. No. 11/460,265 filed Jul. 27, 2006 now U.S. Pat. No. 7,828,199, to Ronald D. Robertson and William D. McKahan entitled "Multi-Layer Heat Insulating Container,", the entire disclosure of which is incorporated herein by reference.

BACKGROUND OF THE INVENTION

Many types of heat-insulating containers have been used commercially to contain hot liquids such as coffee or hot chocolate. Polystyrene foam containers are known and have substantial heat-insulating properties, but containers formed exclusively of polystyrene foam are not environmentally friendly and it is difficult to print an advertisement or logo thereon because foamed styrene containers are often not sufficiently smooth to accept screen printing or other types of printing. Nonetheless, disadvantages in prior art cups formed of paperboard or some other, non-foamed, material are obvious when hot beverages, such as coffee, are being served. For example, most disposable coffee cups are very difficult to handle for several minutes after being filled. However, it can take a person grasping the hot cup several moments to realize that it will be uncomfortable to hold the cup until it cools, and the cup is placed on a table. This situation is problematic with regard to "drive-thru" service since vehicle occupants are often under way again before discomfort is perceived and the options for setting the cup aside are limited. There is thus a need in the art for a heat-insulating container with superior heat-insulating properties capable of being printed upon while being simple and inexpensive to manufacture and assemble.

SUMMARY OF THE INVENTION

The present invention is directed to a storage container including a receptacle having a circumferential sidewall and a sleeve fixedly attached to the receptacle having a circumferential sidewall with a left edge, a right edge, and marginal portions adjacent the left and right edges wherein the edges meet to form a butt seam. The receptacle sidewall and the sleeve sidewall encompass an insulating layer therebetween. The insulating layer includes a first edge and a second edge wherein the first and second edges do not extend under the marginal portions such that the insulating layer has a smaller circumference than that of the sleeve sidewall.

A method of forming a storage container is also provided that includes the steps of wrapping a receptacle circumferential sidewall around a mandrel, joining the receptacle sidewall to a bottom portion, providing a sleeve circumferential sidewall having a left edge and a right edge, marginal portions adjacent the left and right edges, locating a foam insulating layer relative to the inner surface of said sleeve sidewall, sizing the insulating layer to have a smaller circumference than that of the sleeve sidewall, said insulating layer thereby having a first edge and a second edge that do not extend under said marginal portions. The next steps involve foaming the insulating layer, wrapping the sleeve sidewall around the receptacle side such that insulating layer is placed therebetween, meeting a left and right edge of the sleeve sidewall together to form a butt seam, and sealing the butt seam thereby fixedly attaching the sleeve sidewall to the receptacle sidewall.

BRIEF DESCRIPTION OF THE SEVERAL VIEWS OF THE DRAWING

In the accompanying drawings that form a part of the specification and that are to be read in conjunction therewith and in which like reference numerals are used to indicate like parts in the various views.

DETAILED DESCRIPTION OF THE INVENTION

Figure 1:
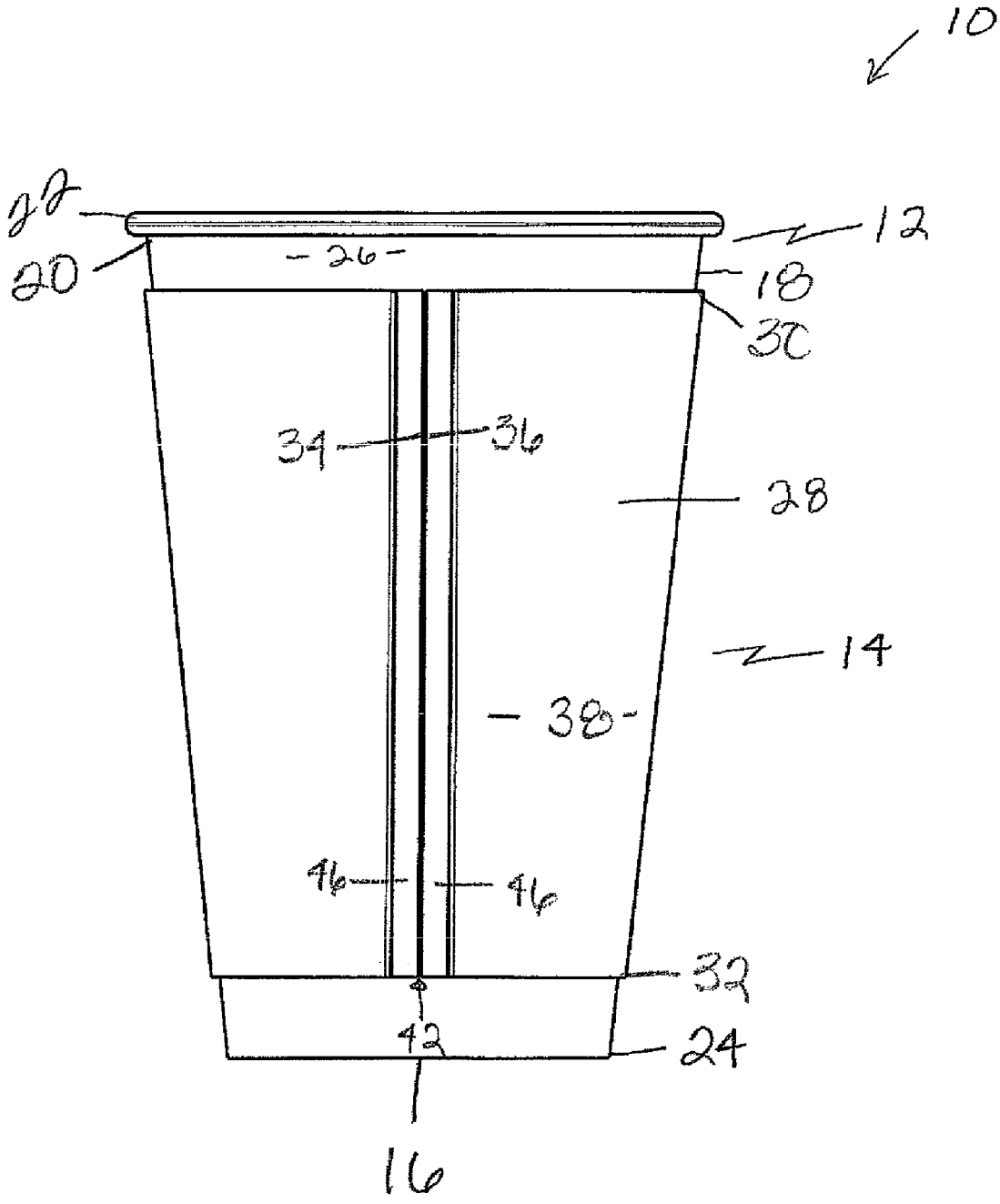
FIG. 1 is a front elevational view of one embodiment of the storage container of the present invention.

A storage container 10 embodying various features of the present invention is shown in the drawings. In a first embodiment, as shown in FIGS. 1-3, storage container 10 includes a receptacle 12 and an integral sleeve 14 fixedly attached thereto.

Figure 2:
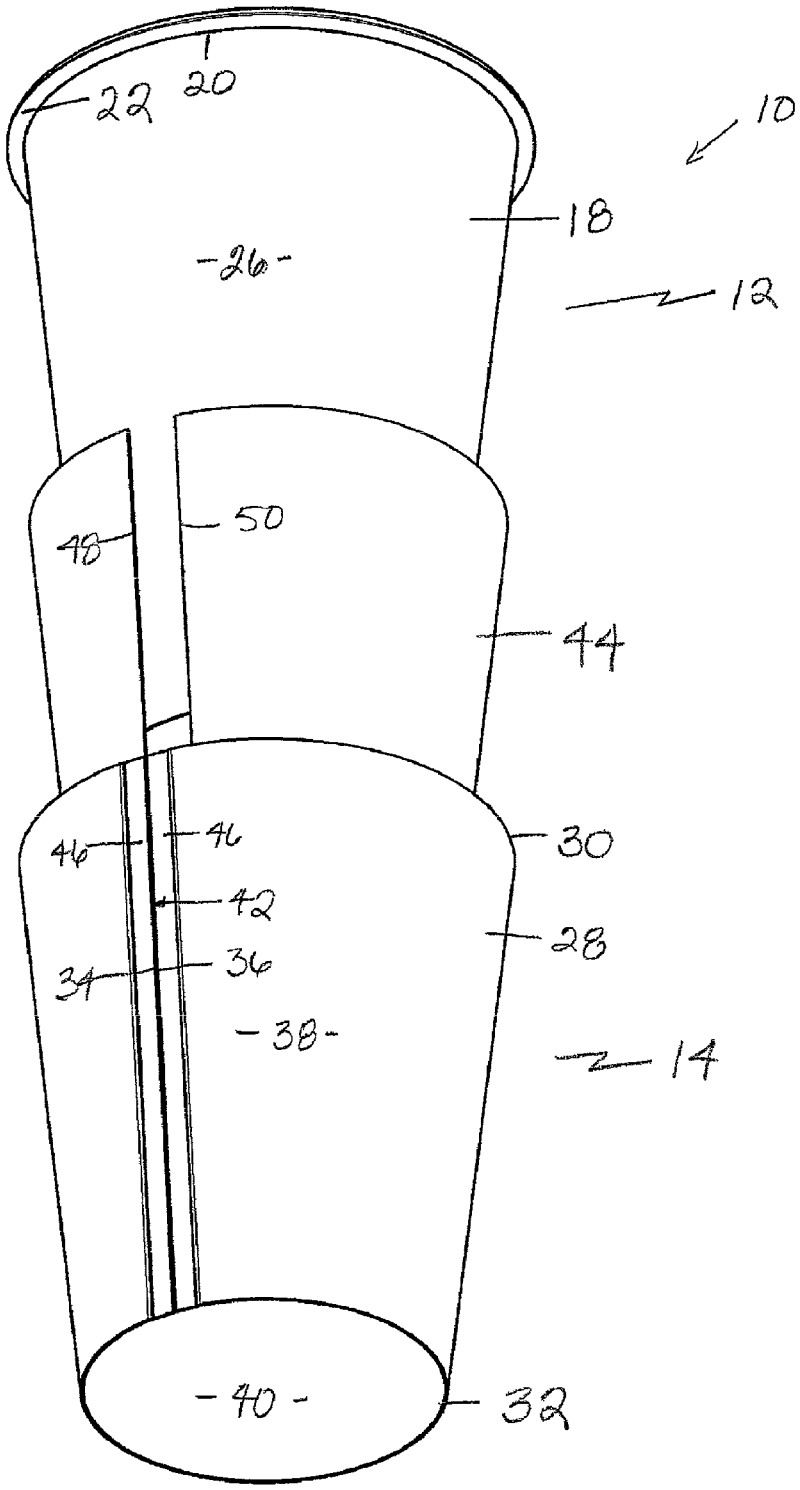
FIG. 2 is an exploded front perspective view of the storage container of FIG. 1.
Figure 3:
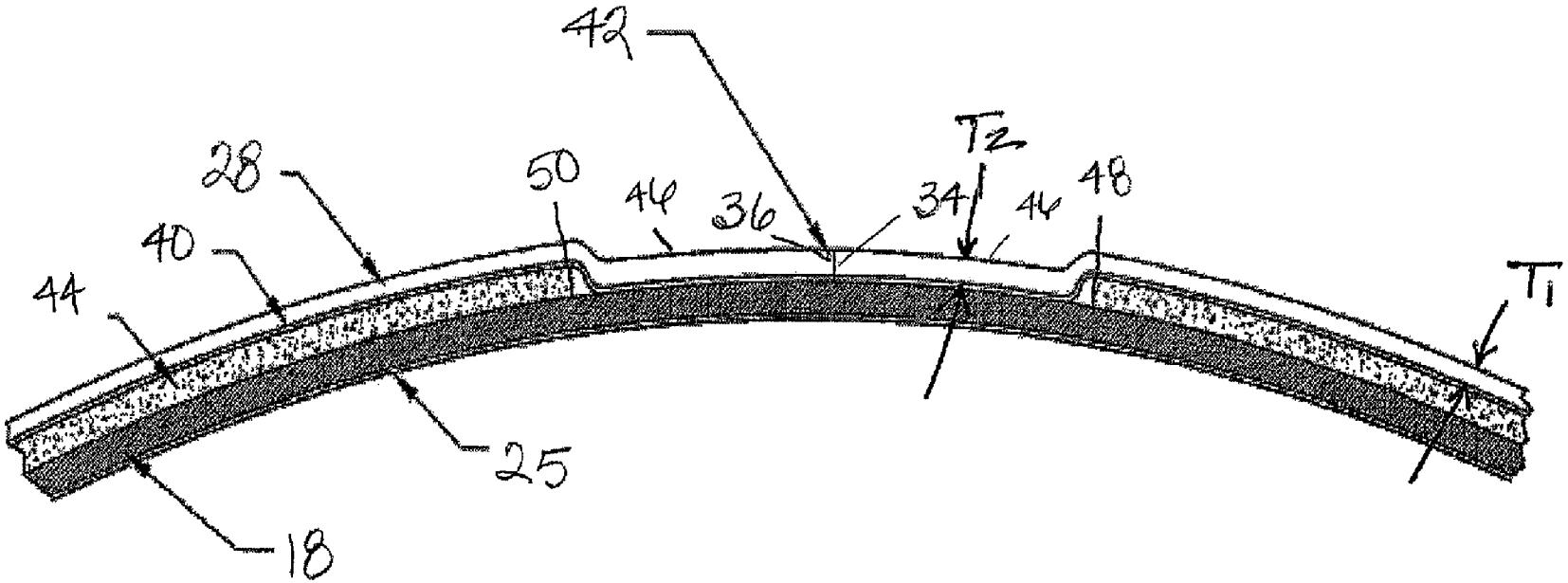
FIG. 3 is a cross-sectional view of the sidewalls of the storage container of FIG. 1 taken through the butt seam of the integral insulating sleeve.

Turning to FIGS. 1, 2 and 3, receptacle 12 has a circular bottom portion 16 and a circumferential sidewall 18. At the top edge 20 of sidewall 18 is a rolled lip 22 to provide a comfortable drinking surface and for attaching a lid (not shown) thereon. Circular bottom portion 16 is defined between a bottom edge 24. Sidewall 18 further includes an inner surface 25 and an outer surface 26. Receptacle 12 preferably has a frusto-conical shape; that is, receptacle 12 has a circular cross-section, and the diameter of bottom edge 24 and bottom portion 16 is less than the diameter of the top edge 20 of sidewall 18. It will be appreciated by those skilled in the art that different shapes may serve equally as well and may be required by a desired application. For example, a receptacle in the shape of a cube may provide better stacking or space utilization characteristics. Receptacle 12 is preferably formed from a sidewall blank which is die-cut from a larger sheet or roll (not shown) of paper or other suitable sheet material such as paperboard, cardboard, laminated paperboard, or thermoplastic materials. Receptacle 12 may be coated on inner surface 25 and/or outer surface 26 with a waterproof or water-resistant material such as polyethylene. Low, medium, or high density polyethylene may be used because it serves as a waterproof coating and to heat weld. Other types of waterproof and heat-sealable coatings including polypropylene and polyester may be used. Other types of biodegradable and/or recyclable waterproof and/or heat-sealable coatings that may be developed hereafter may also be used. Various methods of applying the coating are well known in the art.

Sleeve 14, which is positively closely positioned around sidewall 18 of receptacle 12 between top edge 20 and bottom edge 24, provides structural support to receptacle 12 and also provides an area for printing or advertising. In the embodiment shown in the figures, sleeve 14 is defined by a circumferential sidewall 28 defined by the size of receptacle 12. Sidewall 28 includes a top edge 30, a bottom edge 32, a first side edge 34, a second side edge 36, a printable outer surface 38, and an inner surface 40. Side edges 34 and 36 meet to form a butt seam 42. In this embodiment, sleeve sidewall 28 may have a first thickness T1 (see FIG. 3) and marginal portions 46 immediately adjacent edges 34 and 36 which surrounds the majority of the receptacle 12. The sleeve 14 area comprising marginal portions 46 may have a second thickness T2 wherein T2 is greater, equal to, or less than T1. T1 is preferably in the range of from about 2 to 20 mils and, more preferably, from about 10 to 18 mils.

Sleeve 14 is preferably formed from a sidewall blank which is die-cut from a larger sheet or roll (not shown) of paper or other suitable sheet material such as paperboard, cardboard, laminated paperboard, or thermoplastic materials. Sleeve 14 may include a coating on an inner surface 40 of sidewall 28 and/or receptacle outer surface 38 may include a coating with a waterproof or water-resistant material such as polyethylene. As shown in FIG. 3, a coating is shown on inner surface 40 of sleeve sidewall 28 for welding or bonding purposes as well as water-proofing. Low, medium, or high density polyethylene may be used because it serves as both a heat-weld material and a waterproof coating. Other types of waterproof and heat-sealable coatings including polypropylene and polyester may be used. Other types of biodegradable and/or recyclable waterproof and/or heat-sealable coatings that may be developed hereafter may also be used. Various methods of applying the coating are well known in the art.

Outer surface 26 of sidewall 18 and inner surface 40 of sleeve 40 encompass an insulating layer 44 therebetween to create a three-layered arrangement as shown in FIGS. 2 and 3. When container 10 is filled with a hot beverage or liquid, insulating layer 44 between sleeve 14 and receptacle 12 acts to protect the user's fingers and palm from the discomfort usually associated with holding a hot beverage. In this embodiment, insulating layer 44 may be formed of a thermoplastic synthetic resin and, in particular, a foamed low-to-medium density polymer including, but not limited to, polyethylene, polyolefin, polyvinylchloride, polystyrene, polyester, nylon, and other similar materials that would be suitable for use as an insulating layer. It is within the scope of this invention to create layer 44 from paper material having various forms including, corrugated paper, paper with dimpled surfaces, low density paper, recycled paper and deformed paper or plastic members with air gaps therein. Insulating layer 44 may be a separate layer that is sized to cover most of the inner surface 40 of sleeve sidewall 28. Various methods of making a foam-coated sheet are well known in the art. The preferable thickness of insulating layer 44 is from about 5 to 30 mils and, more preferably, from about 10 to 20 mils. However, it is preferred that insulating layer 44 not extend into or under marginal portion 46. In other words, insulating layer 44 does not extend completely around sidewall 18, i.e., it covers less than 100% of the circumference of the sidewall and has a length L2 depending on the length L1 and the receptacle 12 size. Thus, layer 44 is not as long as sidewall 28 and, as such, first and second edges 48 and 50, respectively, of insulating layer 44 do not form a part of side seam 42. This is advantageous because the thickness of seam 42 is thereby reduced and stacking or cup nesting is thereby facilitated. If it is desirable to increase the thickness of seam 42, then the marginal areas 46 thickness T2 may be increased to thereby effect a seam outer surface that is coextensive with the outer surface of the entire sleeve when assembled into container form. Likewise, in another embodiment, insulating layer 44 may not cover the entire vertical length of sidewall 18 or sleeve sidewall 28, but rather be placed in an area relative to the receptacle where a user is most likely to hold the container/cup. This is advantageous because it reduces paper and other material requirements without significantly affecting the insulating performance of the cup. In addition, by having the sleeve of a lesser size than the outer surface of the receptacle, a user is better informed that the cup is insulated. With such a design, surface transitions help make it obvious to a user that the cup is insulated (due to the fact that the sleeve is smaller than the cup). Accordingly, a user will know that there is no need to double cup or for the coffee shop operator to explain the insulating value of the subject container.

It should also be noted that with this container construction only the receptacle is made of food or higher grade paper. The sleeve 14 may be made of recycled material or paper of a lesser grade thereby effecting a structurally rugged but lower cost sanitary container. Further, the outer surface of sleeve 14 may be textured or perforated for appearance and to enhance the gripping of the container.

To form container 10, first the rolled lip receptacle is formed in a conventional manner by cutting the sidewall to size and wrapping same on a mandrel (not shown) and the bottom portion 16 fixedly attached thereto. Next, sleeve sidewall 28 is cut and a foam insulating layer 44 material is attached on inner surface 40 of sleeve sidewall 28. Hot melt adhesive may be placed at one or more strategic locations between insulating layer 44 and inner surface 40 to ensure that insulating layer 44 remains affixed to inner surface 40 at least as long as it takes to form container 10. Sleeve sidewall 28 having insulating layer 44 on inner surface 40 is then wrapped or bent around receptacle sidewall 18. The wrapping is done such that sleeve side edges 34 and 36 meet but do not overlap at seam 42. Seam 42 is then heat-sealed through the application of heat and pressure or sonically welded in a manner well known in the art. The heat fuses and substantially joins or affixes sleeve 14 to receptacle sidewall 18 at seam 42 by virtue of the previously-applied coating of polyethylene or other heat-sealable and waterproof coating to one or both of receptacle 12 and sleeve 14. This is advantageous because it eliminates the need for a separate adhesive layer. It should be noted that the polyethylene coating could be located on the outer surface 26 of sidewall 18 as well as on the inner surface of sleeve sidewall 28 to effect the heat sealing of the sleeve to receptacle 12. Some surfaces of available paper for this container may not be suitable for heat sealing to polyethylene. With the above construction, additives such as primers are usually not needed to enhance the sealing of the respective surfaces.

From the foregoing, it may be seen that the storage container of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A method of forming a storage container comprising the steps of:

wrapping a receptacle sidewall around a mandrel to form a receptacle;

providing a sleeve sidewall having a left edge and a right edge, marginal portions adjacent said left and right edges, and an insulating layer formed on an inner surface thereof wherein said insulating layer has a first edge and a second edge that do not extend under said marginal portions such that said insulating layer has a smaller circumference than that of said sleeve sidewall;

wrapping said sleeve sidewall around said receptacle sidewall such that said insulating layer is placed therebetween;

meeting a left and right edge of said sleeve sidewall together to form a butt seam and a recessed channel extending along the entire height of said sleeve sidewall; and heat-sealing said butt seam thereby fixedly attaching said sleeve sidewall to said receptacle sidewall.

2. The method of claim 1 wherein said insulating layer is formed on an outer surface of said receptacle sidewall.

3. The method of claim 1 wherein said insulating layer is formed from a thermoplastic synthetic resin.

4. The method of claim 3 wherein said thermoplastic synthetic resin is a foamed polymer selected from the group consisting of polyethylene, polyolefin, polyvinylchloride, polystyrene, polyester, nylon, and mixtures thereof.

5. The method of claim 3, said heat-sealing step comprising sonic welding.

6. The method of claim 3 wherein said layer is formed from a paper product that is defonned to create air gaps therewithin.

7. The method of claim 1 wherein said recessed channel is formed between said insulating layer first and second edges.

8. The method of claim 1 wherein both of said marginal portions and said butt seam are recessed relative to an outermost surface of said sleeve sidewall.

9. The method of claim 1 wherein both of said marginal portions are fixedly attached directly to said receptacle sidewall at a location between said insulating layer first and second edges.

* * * * *